US006163983A

United States Patent [19]

Van Niekerk

[11] Patent Number: 6,163,983

[45] Date of Patent: Dec. 26, 2000

[54] INSOLE WITH AN OPENING

[75] Inventor: Michael Anthony Van Niekerk, Blackmans Bay, Australia

[73] Assignee: Blunstone Pty Ltd, Moonah, Australia

[21] Appl. No.: 09/125,539

[22] PCT Filed: Feb. 28, 1997

[86] PCT No.: PCT/AU97/00117

§ 371 Date: Dec. 17, 1998

§ 102(e) Date: Dec. 17, 1998

[87] PCT Pub. No.: WO97/31548

PCT Pub. Date: Sep. 4, 1997

[30] Foreign Application Priority Data

Feb. 28, 1996 [AU] Australia ..... PN8322

[51] Int. Cl.[7] ..... A43B 13/18

[52] U.S. Cl. ..... 36/28; 36/35 R; 36/37; 12/146 B

[58] Field of Search ..... 36/25 R, 28, 30 R, 36/30 A, 31, 35 R, 37, 27, 32 R; 12/146 B, 146 BR, 142 RS, 142 T

[56] References Cited

U.S. PATENT DOCUMENTS

| | | | |
|---|---|---|---|
| 504,660 | 9/1893 | Blandy | 36/25 R |
| 1,549,237 | 8/1925 | Vaughan . | |
| 1,718,906 | 6/1929 | Hurley | 36/35 R |
| 2,055,574 | 9/1936 | Härtl . | |
| 2,063,186 | 12/1936 | Nichols . | |
| 2,064,629 | 12/1936 | Reggie . | |
| 2,394,281 | 2/1946 | Williams | 36/37 |
| 2,412,226 | 12/1946 | Margolin . | |
| 3,852,895 | 12/1974 | Funck | 12/142 RS |
| 4,079,526 | 3/1978 | Fukuoka | 36/30 R |
| 4,291,428 | 9/1981 | Anzani | 12/146 B |
| 4,513,518 | 4/1985 | Jalbert et al. | 36/43 |
| 4,575,446 | 3/1986 | Schaefer | 12/146 B |
| 4,689,900 | 9/1987 | Ishibashi | 36/30 A |
| 4,861,805 | 8/1989 | Saavedra et al. | 36/32 R |
| 5,381,608 | 1/1995 | Claveria | 36/35 R |
| 5,426,870 | 6/1995 | Purnell et al. | 36/25 R |
| 5,617,651 | 4/1997 | Prahl | 36/27 |

FOREIGN PATENT DOCUMENTS

| | | |
|---|---|---|
| 1179498 | 12/1984 | Canada . |
| 440874 | 1/1936 | United Kingdom . |
| 550656 | 1/1943 | United Kingdom . |

*Primary Examiner*—M. D. Patterson
*Attorney, Agent, or Firm*—Fulbright & Jaworski, L.L.P.

[57] ABSTRACT

An article of footwear is disclosed. The article comprises an insole (3) and a sole element (9) secured to the lower surface (11) of the insole (3). The sole element (9) is formed from a material capable of absorbing impact energy. The article is constructed so that the sole element (9) extends through an opening (15) in the insole (3) and projects to or above the upper surface (7) of the insole (3) and forms a load transfer region for transferring load between a foot of a wearer of the footwear and the sole element (9).

34 Claims, 2 Drawing Sheets

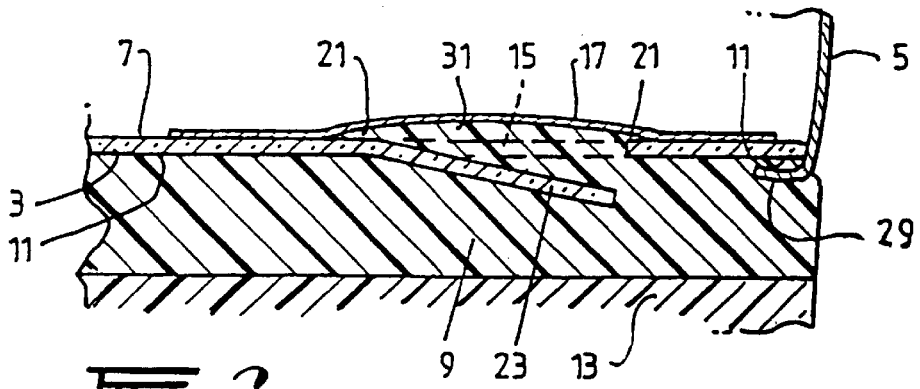
FIG. 2.
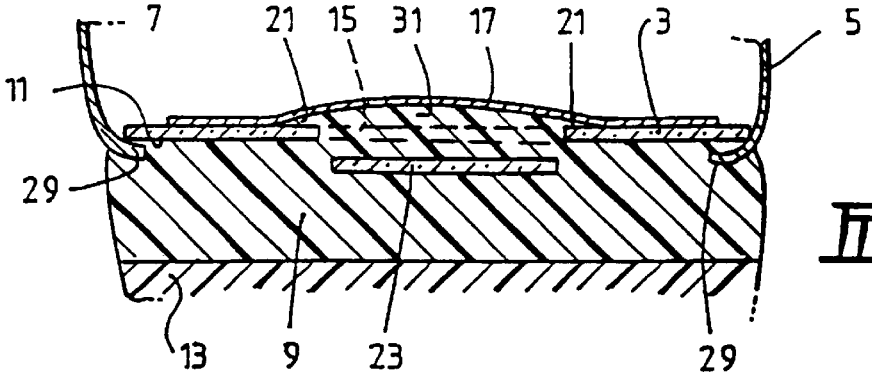
FIG. 4.
FIG. 5.
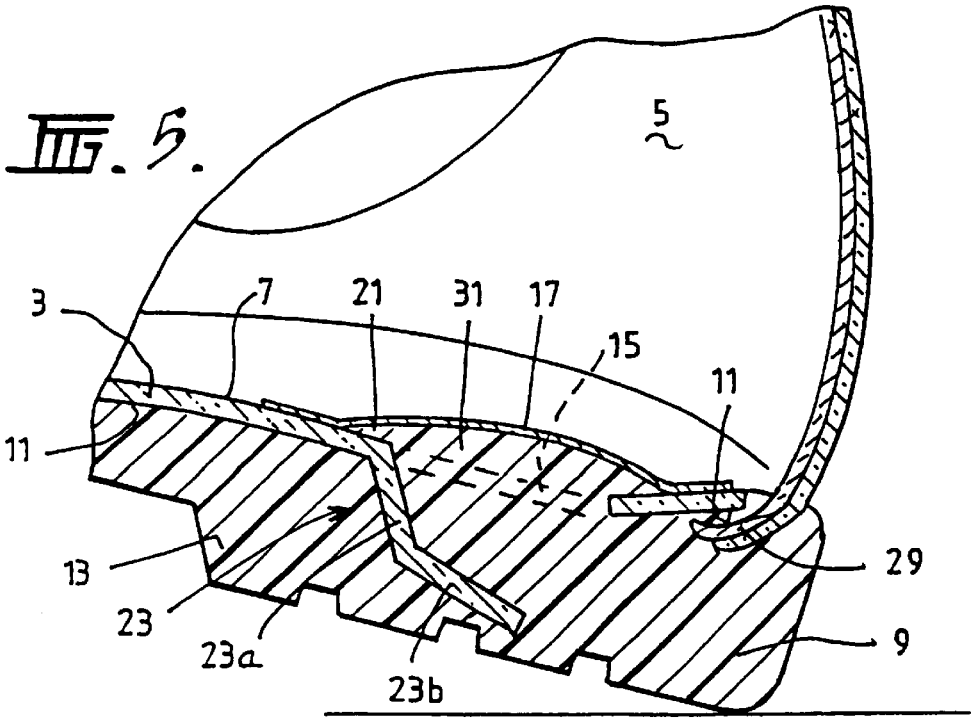

INSOLE WITH AN OPENING

FIELD OF THE INVENTION

The present invention relates to an article of footwear and to a method of manufacturing the footwear.

BACKGROUND OF THE RELATED TECHNOLOGY

During walking in footwear or bare feet ground reaction forces (GRF's) act on the sole of the foot. After the heel strikes the ground the GRF can rise to a maximum of 100% to 140% of a person's body weight. As the force increases to this maximum, usually, there is an oscillation in the magnitude of impact force, known as the "heel strike transient".

The impact force causes a mechanical shock wave known as "impact shock" to propagate through the skeletal system up to the skull. The energy of this shock wave is dissipated as it propagates through bone, soft tissue and muscle. The degree of dissipation can vary depending on the motion and muscle action at the joints, particularly the joints of the lower limbs, and any degenerative changes that may have occurred at the joints.

The heel pad is a fatty fibrous structure that, in a healthy state, is capable of absorbing up to 80% of the heel strike peak acceleration propagated to the tibia. The heel pad can have better shock absorbency than Sorbothane (Trade Mark) or EVA foam which are commonly used in good quality running shoes.

The effectiveness of the body's natural shock absorbing mechanisms can be reduced in the case of musculoskeletal disease, trauma or mechanical fatigue. Lack of adequate shock absorption can cause larger acceleration transients to propagate through the skeletal system. Larger impact forces can result in overuse injury and mechanical fatigue at the joints of the lower limbs and in the spine.

The shock absorption capabilities of the heel pad can be enhanced by wearing footwear that has a heel counter that confines the heel pad and by placing a shock absorbing material or device (such as an air system, liquid system, and valve system) under the heel to absorb impact energy generated at heel strike and thereby reduce the magnitude of the impact force. The effectiveness of known systems varies considerably. Moreover, in many instances, known systems require the addition of components to a conventional article of footwear and therefore increase the material costs and make more difficult the manufacture of the footwear.

SUMMARY OF THE INVENTION

An object of the present invention is to provide an article of footwear which is capable of minimising impact shock.

According to the present invention there is provided an article of footwear comprising:

(a) an insole having an upper surface, a lower surface, and an opening; and (b) a sole element secured to the lower surface of the insole and extending through the opening in the insole to project to or above the upper surface of the insole to form a load transfer region for transferring load between a foot of a wearer of the footwear and the sole element, and the sole element comprising a material capable of absorbing impact energy.

The present invention is based on the realisation that the above construction of the sole element optimises absorption of energy at impact and thereby minimises impact force and impact shock. Without wishing to be bound by a particular theory, the applicant believes that this substantial advantage of the footwear is achieved because there is direct load transfer between the foot and the sole element which avoids or minimises interference to load transfer caused by the insole.

It is preferred that the sole element extend through the opening in the insole to project above the upper surface of the insole.

It is preferred, although not essential, that the load transfer region be dome-shaped.

The opening in the insole may be of any suitable shape.

The opening in the insole may be in any suitable location.

It is preferred that the opening in the insole be in the heel section of the footwear.

The footwear may comprise more than one opening in the insole.

It is preferred that the sole element be secured to the lower surface of the insole by moulding the sole element onto the lower surface.

It is preferred that the sole element comprises a midsole and that the footwear further comprises an outsole secured to the midsole.

Alternatively, in a situation where the footwear does not include a midsole, the sole element may comprise the outsole only.

It is preferred that the impact energy absorbing material be a resilient material.

It is preferred particularly that the impact energy absorbing material be selected from the group comprising polyurethane rubber (natural or synthetic), PVC, and any other suitable polymeric material.

It is preferred more particularly that the impact energy absorbing material be expanded polyurethane.

It is preferred that the footwear further comprises a member that extends across the opening and is secured to the upper surface of the insole.

It is preferred that the member be a barrier.

It is preferred particularly that the barrier member be a membrane.

It is preferred more particularly that the membrane be flexible.

It is preferred that the sole element extend through the opening in the insole and be secured to the upper surface of the insole in the region of the opening.

It is preferred that the footwear further comprises a reinforcing/stiffening member embedded in the sole member in the region of the opening in the insole.

It is preferred that the reinforcing/stiffening member extends transversely to the plane of the insole.

It is preferred that the opening in the insole be formed by cutting the insole to form a flap and thereafter bending the flap downwardly from the plane of the insole.

It is preferred that the footwear further comprises an upper secured to the insole.

According to the present invention there is also provided a method of manufacturing an article of footwear, the footwear comprising an insole, an upper secured to the insole, and a sole element moulded to the insole, the upper comprising toe, side, and heel sections, and the sole element being formed from a material capable of absorbing impact energy, the method comprising the following steps:

(a) cutting a section of the insole to form a flap which is integrally connected to the insole—without displacing the flap from the plane of the insole;

(b) securing the upper to the insole;

(c) displacing the flap from the plane of the insole so that the flap extends downwardly transversely to the plane of the insole, thereby to form an opening in the insole; and (d) securing the sole element to a lower surface of the insole so that the flap extends into the sole element and the sole element extends through the opening to project to or above an upper surface of the insole to form a load transfer region for transferring load between a foot of the wearer of the footwear and the sole element, and the sole element comprising a material capable of absorbing impact energy.

The applicant has found that the above-described method is particularly advantageous because it enables the footwear to be manufactured on conventional equipment and avoids substantial capital expenditure for new equipment and/or modifications to existing equipment.

It is preferred that step (b) comprises:

(i) securing the toe section of the upper to the insole in a toe lasting machine; and (ii) securing the side and heel sections of the upper to the insole in a side and heel lasting machine.

It is preferred that step (d) comprises securing the sole element by moulding the sole element to the insole.

In a situation where the sole element is moulded onto the insole, it is preferred that the method further comprises a step between steps (a) and (b) of securing a barrier member to an upper surface of the insole to extend across the flap. The purpose of the barrier member is to limit the penetration of sole material through the opening in the insole during the moulding step.

It is preferred that the sole element be a midsole and that the method further comprises moulding an outsole to the midsole.

According to the present invention there is also provided an insole for an article of footwear, the insole comprising an upper surface, a lower surface, and an opening for receiving a section of a sole element formed from a material capable of absorbing impact energy so that the section forms a load transfer region projecting to or above the upper surface of the insole.

It is preferred that the opening be formed by cutting out a section of the insole to form a flap that is integrally connected to the insole and can be displaced from the plane of the insole to form a reinforcing/stiffening member.

According to the present invention there is also provided a sole unit for an article of footwear, the sole unit comprising:

(a) an insole having an upper surface, a lower surface, and an opening; and (b) a sole element comprising a material capable of absorbing impact energy secured to the lower surface of the insole and extending through the opening in the insole to project to or above the upper surface of the insole to form a load transfer region for transferring load between a foot of a wearer of the footwear (when constructed) and the sole element.

BRIEF DESCRIPTION OF THE DRAWINGS

The present invention is described further by way of example with reference to the accompanying drawings in which:

FIG. 2 is a cross-section along the line 2—2 of FIG. 1;

FIG. 4 is a cross-section along the line 4—4 of FIG. 1; and

FIG. 5 is a cross-section similar to that shown in FIG. 2 which illustrates another preferred embodiment of an article of footwear in accordance with the present invention.

DETAILED DESCRIPTION OF THE INVENTION

Figure 1:
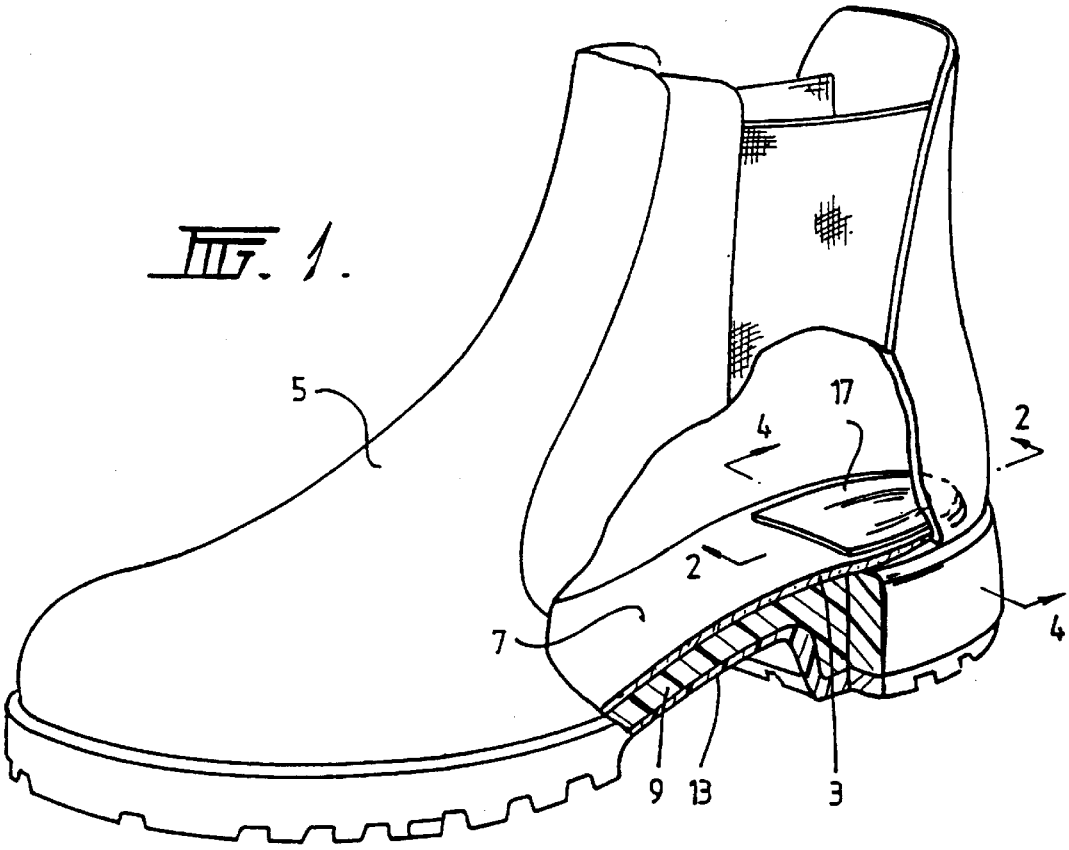
FIG. 1 is a partially cut-away perspective view of an article of footwear formed in accordance with one preferred embodiment of the present invention.

The article of footwear shown in FIGS. 1 to 4 comprises an insole 3, an upper 5 having an upper margin 29 that is wrapped over the edge of the insole 3 and secured to a lower surface 11 of the insole 3, a midsole 9 moulded to the lower surface 11 of the insole 3 and to the upper margin 29, and an outsole 13 (which defines a tread of the footwear) moulded to the midsole 9.

The midsole 9 is formed at least in part from a material that is capable of absorbing impact energy, such as expanded polyurethane or any other suitable resilient material.

The midsole 9 and the outsole 13 may be of dual density with, by way of example, the midsole 9 being made from expanded polyurethane of specific gravity of the order of 0.6 gm/cc which forms a cushion layer, and the outsole 13 being made from polyurethane of specific gravity of the order of 1 gm/cc which forms a relatively tough outer skin. Alternatively, the midsole 9 and the outsole 13 may be of single density.

The insole 3 is formed with an opening 15 in the heel section, and the midsole 9 extends through the opening 15 and projects above the upper surface 7 of the insole 3 to form a generally dome-shaped load transfer region 31 for transferring load between a heel of the wearer of the footwear and the midsole 9 when the footwear contacts the ground.

In this connection, the applicant has found that this arrangement of the opening 15 and the midsole 9 optimises absorption of energy at impact and thereby minimises impact shock. It is believed by the applicant that this substantial advantage of the footwear is achieved because there is direct load transfer via the load transfer region 31 between the foot and the midsole 9 which avoids or at least minimises interference to load transfer by the insole 3.

Another advantage of the arrangement of the opening 15 and the midsole 9 is that it does not involve components, such as the prior art gel filled capsules, air cavities and valving arrangements, that may fail in service. In addition to this simplicity of construction, the inherent strength and reliability of the footwear of the present invention also stems from the fact that in its preferred form the invention comprises a homogeneous unit in which all of the components are bonded together. Thus, there is not only an absence of complex components but also "voids" and unbonded joints and boundary layers that result from the inclusion of these components in footwear.

A further advantage of the arrangement of the opening 15 and the midsole 9 is that, in accordance with a preferred embodiment of a method of manufacture in accordance with the present invention, the footwear may be manufactured using conventional toe lasting machines and side and heel lasting machines and therefore substantial expenditure on new equipment or on modifications of existing equipment is not required in order to manufacture the footwear. It is noted that the present invention is not limited to this method of manufacture and the footwear may be manufactured with any suitable technology including, but not limited to: strobel stitched/slip lasting; string lasting; stitch down/Veltschoen; Goodyear welt; and cemented or stitched unit soles.

Figure 3:
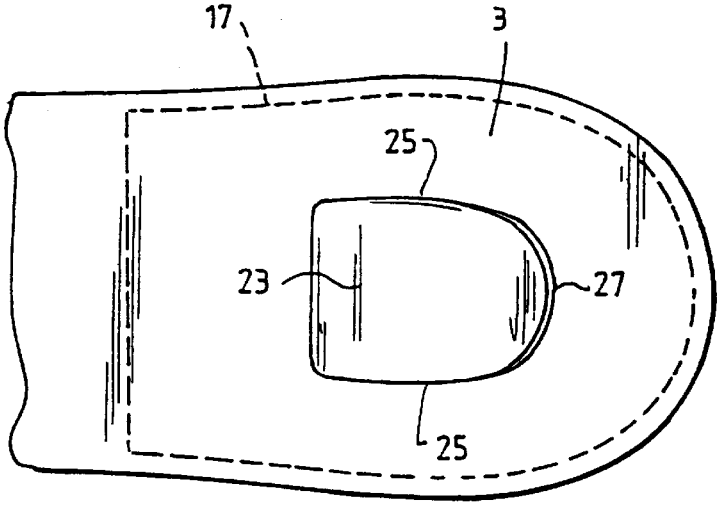
FIG. 3 is a top plan view of a heel section of the insole.

With particular reference to FIGS. 2 and 3, the opening 15 is formed by die-cutting the insole 3 to form a flap 23 having parallel sides 25 and a curved terminal end 27 and by bending the flap 23 downwardly at the junction between the flap 23 and the insole 23 so that it extends transversely to the plane of the insole 3 and extends into the midsole 9.

The flap 23 has a number of important functions. Firstly, the flap 23 acts as a reinforcement/stiffener of the midsole 9. In particular, this feature improves the torsional stability of the footwear and responds as a spring "hinge". Secondly, the flap 23 forms a barrier to inhibit penetration of sharp objects through the opening 15 into the foot of a wearer of the footwear. Thirdly, the flap 23 assists in manufacture of the footwear in accordance with a preferred method that is described below.

With reference to FIG. 5, in the preferred embodiment shown in that Figure the flap 23 is of a similar construction to the arrangement shown in FIGS. 2 and 3, save that the flap 23 is bent downwardly a greater angle to the plane of the insole 3 than the arrangement shown in FIGS. 2 and 3 and, in order to accommodate the flap 23 is in the midsole 9, the flap 23 is bent upwardly mid-way along its length. As a consequence, the flap 23 has a steeply inclined inner section 23*a* and a less steeply inclined outer section 23*b*.

A particular advantage of the embodiment shown in FIG. 5 is that the flap 23 is displaced further away from the opening 25 than the arrangement shown in FIGS. 2 and 3 and thereby minimises interference of the flap 23 in the forming of the load transfer regions 31.

With further reference to the Figures, the footwear further comprises a flexible membrane 17 that extends across the opening 15 and is secured to the upper surface 9 of the insole 3. As is described in more detail hereinafter, the principal purpose of the membrane 17 is to form a barrier to limit the flow of midsole material through the opening 15 and thereby to control the shape of the load transfer region 31 during moulding of the midsole 9 onto the insole 3 in accordance with the preferred method of manufacture.

The membrane 17 is secured to the upper surface 7 of the insole 3 so that there is a section 21 of the upper surface 7 (FIGS. 2 and 4) that separates the edge of the opening 15 and the region of contact between the membrane 17 and the insole 3. The midsole 9 extends across and is secured to this section 21 of the upper surface 7. This feature further improves the performance of the footwear.

Furthermore, the opening 15 comprises a radiussed edge (not shown) which in the preferred method assists in the flow of midsole material through the opening 15 during moulding of the midsole 9 onto the insole 3 in accordance with the preferred method of manufacture.

The preferred method of manufacture of the footwear comprises a first step of die-cutting the flap 23 in the insole 3 and thereafter securing the membrane 17 to the upper surface 7 of the insole 3.

The assembly of the insole 3 and the membrane 17, with the flap 23 in the plane of the insole 3, is then positioned on a conventional toe lasting machine (not shown) and the machine is operated to secure the toe section of an upper 5 to the lower surface 11 of the insole 3. The assembly is then transferred to a conventional side and heel lasting machine (not shown) and the machine is operated to secure the side and heel sections of the upper 5 to the lower surface 11 of the insole 3.

It is noted that an important requirement of conventional lasting machines is that an insole be sufficiently rigid to act as a stable base. The applicant has found that the above-described assembly of the insole 3/flap 23/membrane 17 has sufficient rigidity and therefore can be used without difficultly on conventional lasting machines.

After the upper 5 is secured to the insole 3, the flap 23 is displaced downwardly away from the plane of the insole 3 to form the opening 15. Thereafter, the assembly of the upper 5/insole 3 is positioned on a conventional injection moulding machine (not shown) and the machine injects outsole material into a cavity in the bottom of the mould assembly to form the outsole 13.

The final step of the method comprises injecting midsole material into the space between the upper 5/insole 3 assembly and the outsole 13.

In order to investigate the performance of the footwear of the present invention the applicant retained the School of Human Biosciences, Faculty of Health Sciences, LaTrobe University, Victoria, Australia to carry out a study on the preferred embodiment of footwear in accordance with the present invention having the bent flap 23 as shown in FIG. 2.

In the study the heel strike transient of the ground reaction force (GRF) was measured as subjects walked over a force plate. The acceleration transient propagated to the tibia, while walking, was measured using an accelerometer. The effectiveness in reducing the GRF and tibial acceleration transients was measured relative to a standard article of footwear. Lace-up and elastic sided styles of footwear were tested. The heels were also statically tested by striking them with a pendulum (hammer) and observing the acceleration transient transmitted through the heel.

METHOD

Static Impact Tests

Static impact tests were performed by allowing a hammer-shaped pendulum to strike footwear on the lateral, posterior region of the heel. The pendulum was mounted in a frame that was secured to the test bench. The pendulum was 0.94 min length and had a mass of 3.65 kg, the cylindrical striking-head of the pendulum was 0.087 m long and 0.045 m in diameter with a mass of 1 kg. Footwear was mounted on a suitably sized SACH prosthetic foot (1D20 Otto Bock Dynamic Pro) attached to a 0.13 m long trans-tibial pylon (Otto Bock tube adaptor). A thin nylon sock was placed over the foot to reduce friction between the leather footwear and the rubber foot. The pylon was affixed to a rigid mounting frame secured to the test bench. An accelerometer (Kulite GY125-10) was mounted on the pylon, midway along its length, to measure the acceleration transients due to the shock of impact transmitted longitudinally along the pylon. The point of impact on the heel was positioned at the equilibrium position of the striking-head of the pendulum. The pendulum was displaced 40° from its equilibrium position and held in a release mechanism, upon release it was allowed to fall freely to strike the heel.

The accelerometer was supplied with an excitation voltage of 15 V dc from a regulated power supply (Tektronix PS501-1). The accelerometer output was amplified by a differential amplifier (Tektronix AM502) using a 300 Hz low pass filter. Output from the amplifier was sampled at a rate of 1 kHz by an A-D converter (Maclab/4 controlled by Scope v3.2.6 and a Macintosh Classic computer). Shock of impact was then quantified from the output record by measuring the magnitude of the first negative peak after impact. A reduction in magnitude indicated increased shock absorption by the heel of the footwear. Five impact tests were performed on each article of footwear.

Four types of footwear were tested, namely:

(i) conventional footwear—lace-up, (ii) the preferred embodiment footwear—lace-up, (iii) conventional footwear—elastic-sided, and (iv) the preferred embodiment footwear—elastic-sided.

There were six pairs of each type of footwear, with two pairs each of sizes 7, 8, and 9. A total of 48 articles of footwear were tested. Footwear size was determined by the foot size of each subject for the dynamic impact tests, otherwise footwear was selected at random from stock held by the applicant.

Dynamic Impact Tests

Six subjects donned footwear for the dynamic testing. All subjects were in good health and had no history of lower limb pathologies. Five of the subjects were male, and one female. Average age, stature and mass were 36 years, 1.778 m and 78.8 kg respectively (Table 1). Two of the subjects wore size 7 footwear, another two wore size 8 and the final two wore size 9.

TABLE 1

Body mass, stature, age and gender for the six subjects participating in the dynamic trials

| Subject | Body mass (kg) | Stature (m) | Age (years) | Gender | Boot size |
|---|---|---|---|---|---|
| 1 | 75.5 | 1.730 | 23 | F | 7 |
| 2 | 69.3 | 1.655 | 48 | M | 7 |
| 3 | 92.2 | 1.850 | 21 | M | 9 |
| 4 | 78.3 | 1.830 | 47 | M | 8 |
| 5 | 83.7 | 1.800 | 35 | M | 9 |
| 6 | 73.6 | 1.805 | 40 | M | 8 |

Each subject was instructed to walk at a constant cadence down a 10 m walkway. Cadence was regulated by having the subjects synchronise their steps with the beat of a metronome cadences of 100 and 120 steps/min were used.

Each subject performed a total of 40 trials with each of the 4 footwear types. At least 2 days separated the testing of each footwear type to allow the subjects to acclimatise to wearing a footwear type.

For each footwear type 10 trials using the force plate were performed at each of the cadences (100 and 120 steps/min). The vertical component of the ground reaction force ($F_z$.) was measured by a force plate (Kistler 9281B force plate) mounted flush with the floor in the walkway. Each subject started walking at a distance of approximately 6 m from the force plate. The starting position was set so that the subject contacted the force plate with their right foot.

Also, for each footwear type 10 trials using the accelerometer were performed at each cadence. Acceleration transients transmitted longitudinally along the tibia after the heel strike were measured using an accelerometer (Kulite GY125-10) that was firmly secured medially and proximally to the anterior of the right tibia (tibial flare). Accelerometer output was recorded for the step where the foot struck the force plate.

The force platform output was amplified (Kistler 5007 Y15 charge amplifiers, Kistler 5217 summing amplifiers, Kistler 5215 Y12 analogue divider and Kistler 5675 central control unit) and sampled at a rate of 1 kHz by an A-D converter (Maclab/8 controlled by Scope v3.2.6 and a Macintosh LC475 computer). The $F_z$ output exhibited a heel strike transient after heel contact, and the transient resulted in impact force peaks $F_1$ and $F_2$.

For this study the magnitude of the first impact force peak ($F_{zi}$) and the time ($\Delta t$) from heel contact to this peak were measured. The impact force rate ($FR_{zi}$) was then calculated by $$FR_{zi}=F_{zi}/\Delta t.$$

The accelerometer used to measure acceleration transients transmitted to the tibia after heel strike was supplied with an excitation voltage of 15 V dc from the regulated power supply (Tektronix PS501-1). The accelerometer output was amplified by a differential amplifier (Tektronix AM502) using a 300 Hz low pass filter. Output from the amplifier was sampled at a rate of 1 kHz by an A-D converter (Maclab/8 controlled by Scope v3.2.6 and a Macintosh LC475 computer). Shock transmitted to the tibia after heel strike was then quantified from the output record by measuring the magnitude of the first positive peak after heel strike. This is commonly referred to as the initial peak tibial acceleration (IPA). A reduction in magnitude indicated increased shock absorption by the heel of the footwear.

Statistical Analysis

For the static impact testing a 2 group unpaired Student's t test was performed to compare the initial peak acceleration transmitted through the 24 articles of footwear with the conventional heel and the 24 preferred embodiments.

For the statistical analysis of the dynamic data a series of planned comparisons was performed in which paired t tests were used to compare the parameters recorded from the subjects when wearing the conventional footwear with those measurements taken when wearing the preferred embodiments. To compensate for accumulation of family wise error due to multiple comparisons, a Bonferroni adjustment was made and the significant levels for the comparisons altered accordingly.

RESULTS

The mean initial peak acceleration in response to the impact of the 24 conventional articles of footwear was 3.450 g (Std. Dev., 0.244).

The mean initial peak acceleration in response to the impact of the 24 preferred embodiments was 3.035 g (Std. Dev., 0.267).

The difference between the means, which amounts to 12.0% less peak acceleration in the preferred embodiments than in the conventional footwear, was significant ($t=11.9$, $p<0.0001$).

The mean values for the 3 shock parameters measured during the dynamic trials when subjects wore the preferred embodiments are shown in Table 2.

TABLE 2

Mean values of shock measurements for all subjects wearing preferred embodiments

| | All lace-up | Lace-up fast | All Elastic | Elastic fast |
|---|---|---|---|---|
| IPA (g) | 1.762 | 1.928 | 1.780 | 2.039 |
| $F_{zi}$ (N/kg) | 5.189 | 5.860 | 4.788 | 5.994 |
| $FR_{zi}$ (N/kg.s) | 129.39 | 149.50 | 119.85 | 142.83 |

"All Lace-up" and "All Elastic" columns combine the data take from all subjects walking at both speeds in lace-up boots and elastic sided boots respectively. "Lace-up fast" and "Elastic fast" columns contain data obtained when walking at the higher speed only.

The values for elastic and lace-up boots are similar with no significant differences within conditions. As would be expected the values for the shock parameters increased with increased walking speed.

The 3 shock parameters measured during the dynamic trials were significantly lower for the group of subjects when walking in the preferred embodiments than when walking in the conventional articles of footwear. The differences are summarised in Table 3.

TABLE 3

| | Percentage decrease in shock measurements of preferred embodiments compared to conventional footwear worn by all subjects | | | |
|---|---|---|---|---|
| | All lace-up | Lace-up fast | All Elastic | Elastic fast |
| ZPA | 26.8 | 32.8 | 22.5 | 22.5 |
| $F_{zi}$ | 10.0+ | 9.1^ | 6.3 | 7.8^ |
| $FR_{zi}$ | 19.5 | 19.3 | 11.8 | 15.5 |

"All Lace-up" and "All elastic" columns combine the data taken from all subjects walking at both speeds in lace-up boots and elastic sided boots, respectively. "Lace-up fast" and "elastic fast" columns contain data obtained when walking at the higher speed only. All values are significant at $p < .001$ except $p < .005$, ^$p < .05$ after Bonferroni adjustment.

The values shown in Table 3 are the mean for all trials from all subjects tested and generally show a large difference between heels.

Despite these large, significant differences for the group there was a variation between individuals. For some subjects there were only small differences between parameters when wearing footwear with the different heels. For others, who tended to have a higher impact acceleration, the mean differences were large and could be as high as 50%. There was a strong positive correlation between the magnitude of IPA and the difference in shock between heels. A regression analysis was performed in which the mean difference in IPA for each subject when wearing preferred embodiments and conventional footwear was correlated with the individual's mean IPA in conventional footwear. Linear regression yielded a coefficient of determination ($r^2$) of 0.657 ($p=0.0014$) indicating that 66% of the inter-subject variation in the mean difference between the shock absorbing capacity of the two heels could be accounted for by the magnitude of the impact acceleration.

DISCUSSION

The study provided objective measurements of the shock absorbing capacity of the conventional footwear and the preferred embodiments both in controlled static bench tests and in conditions typical of normal use.

The significant reductions in all shock parameters in both the static and dynamic testing clearly indicated that preferred embodiments had superior shock absorbing capacity than the conventional footwear and, on average, provided superior cushioning while subjects walked.

Of the shock related parameters used in the study, IPA and $FR_{zi}$ are generally better monitors of changes in shock absorption than is $F_{zi}$ when people walk in shoes. $F_{zi}$ indicates only the magnitude of the impact force of the heel strike transient and does not take into account the rate at which force increases. As indicated above, wearing appropriate footwear markedly reduces the magnitude of the impact when compared to walking in bare feet. It is theoretically possible that $F_{zi}$ could be higher when wearing certain footwear yet have increased shock absorption because of a slower rate of force increase. In the study it was found that $F_{zi}$ for subjects wearing the preferred embodiments was significantly less than when wearing the conventional footwear. The decrease in $FR_{zi}$ when wearing the preferred embodiments was proportionally greater than the decrease in $F_{zi}$ which may indicate that the superiority of the shock absorbing properties of the preferred embodiments relates to reducing both the magnitude of the impact force and the rate at which the force increases.

The group of subjects used in the study provided a range of heights, weights, shoe size and walking styles which suggest the results of the dynamic tests would generalise to a large proportion of the adult population.

There was a tendency for the superiority in shock absorption with the preferred embodiments to be greater when higher transient peak accelerations occurred either due to the nature of an individual's walking characteristics or, within subjects, due to an increased walking speed. These observations suggest that the advantage of the preferred embodiments increased as larger acceleration transients are applied to the leg. Higher acceleration transients may occur when carrying a load and in many other physical activities where the normal walking style is altered.

Many modifications may be made to the preferred embodiment of the present invention described above without departing from the spirit and scope of the invention.

For example, whilst the opening 15 is located in a heel section of the preferred embodiment of the footwear shown in the figures it can readily be appreciated that the present invention is not restricted to this arrangement and the opening 15 may be positioned in any required section of the footwear.

In addition, it can readily be appreciated that the footwear may include more than one such openings 15.

In addition, whilst the preferred embodiment comprises a generally dome-shaped load transfer region 31, it can readily be appreciated that the present invention is not restricted to this arrangement and the load transfer region 31 may be of any suitable shape.

In addition, whilst the preferred embodiment of the footwear shown in the figures comprises a flap 23 cut-out from the insole 3, it can readily be appreciated that the present invention is not restricted to this arrangement. For example, the flap 23 may be separate from the insole 3 and formed from a different material from that of the insole 3. Furthermore, the flap 23 may be of a shape that is different to that of the opening 15 and/or located in any suitable orientation, ie. at a range of angles and different planes, to optimise the performance of the flap 23.

Furthermore, whilst the above description in relation to the drawings is in the context of a completed article of footwear, it can readily be appreciated that the present invention is not so limited and extends to the insole element per se and to a sole unit comprising the insole and the sole element formed from a material capable of absorbing impact energy secured to the insole.

The foregoing description is illustrative and not limiting. Obvious variations will occur to those of skill in the art. These variations are intended to be encompassed by the invention, which is limited only by the scope and spirit of the appended claims.

What is claimed is:

1. An article of footwear which comprises:

(a) an insole having an upper surface, a lower surface, and an opening; said opening including a flap angled downwardly from a plane of the insole; and (b) a sole element comprising expanded polyurethane molded to the lower surface of the insole and extending through the opening in the insole and projecting at least to the upper surface of the insole and forming a load transfer region for transferring load between a foot of a wearer of the footwear and the sole element.

2. The article of footwear of claim 1, wherein the sole element extends through the opening in the insole to project above the upper surface of the insole.

3. The article of footwear of claim 1, wherein the load transfer region is dome-shaped.

4. The article of footwear of claim 1, wherein the opening in the insole is in a heel section of the footwear.

5. The article of footwear of claim 1, further comprising a member extending across the opening and secured to the upper surface of the insole.

6. The article of footwear of claim 5, wherein the member is a barrier.

7. The article of footwear of claim 6, wherein the barrier is a flexible membrane.

8. The article of footwear of claim 1, wherein the sole element extends through the opening in the insole and is secured to the upper surface of the insole in the region of the opening.

9. The article of footwear of claim 1, further comprising a reinforcing member embedded in the sole element in the region of the opening in the insole.

10. The article of footwear of claim 9, wherein the reinforcing member extends transversely to a plane of the insole.

11. A method of manufacturing an article of footwear, the footwear comprising an insole, an upper secured to the insole, and a sole element molded to the insole, the upper comprising toe, side, and heel sections, and the sole element being formed from a material capable of absorbing impact energy, the method comprising the steps of:

(a) cutting a section of the insole to form a flap which is integrally connected to the insole while keeping the flap within a plane of the insole;

(b) securing the upper to the insole;

(c) displacing the flap from the plane of the insole by extending the flap downwardly transversely to the plane of the insole, thereby forming an opening in the insole; and (d) molding the sole element to a lower surface of the insole with the flap extending into the sole element and the sole element extending through the opening to project at least to an upper surface of the insole to form a load transfer region for transferring load between a foot of a wearer of the footwear and the sole element.

12. The method of claim 11, wherein step (b) includes:

(i) securing the toe section of the upper to the insole in a toe lasting machine; and (ii) securing the side and heel sections of the upper to the insole in a side and heel lasting machine.

13. An article of footwear which comprises:

(a) an insole having an upper surface a lower surface, and an opening;

(b) a sole element comprising an impact energy absorbing material molded to the lower surface of the insole and extending through the opening in the insole and projecting above the upper surface of the insole and forming a dome shaped load transfer region for transferring load between a foot of a wearer of the footwear and the sole element; said sole element being secured to the upper surface of the insole in the region of said opening; and (c) a member extending across the opening and secured to the upper surface of the insole.

14. The article of footwear of claim 13, wherein the opening in the insole is in a heel section of the footwear.

15. The article of footwear of claim 13, wherein the impact energy absorbing material is a resilient material.

16. The article of footwear of claim 15, wherein the impact energy absorbing material comprises polyurethane.

17. The article of footwear of claim 16, wherein the impact energy absorbing material is expanded polyurethane.

18. The article of footwear of claim 15, wherein the impact energy absorbing material comprises natural rubber or synthetic rubber.

19. The article of footwear of claim 15, wherein the impact energy absorbing material comprises PVC.

20. An article of footwear which comprises:

(a) an insole having an upper surface, a lower surface, and an opening;

(b) a sole element comprising expanded polyurethane molded to the lower surface of the insole and extending through the opening in the insole and projecting at least to the upper surface of the insole and forming a load transfer region for transferring load between a foot of a wearer of the footwear and the sole element; and (c) a reinforcing member embedded in said sole element in the region of the opening in said insole, and reinforcing member including a flap angled downwardly from the plane of the insole.

21. The article of footwear of claim 20, wherein the sole element extends through the opening in the insole to project above the upper surface of the insole is a resilient material.

22. The article of footwear of claim 20, wherein the load transfer region is dome-shaped.

23. The article of footwear of claim 20, wherein the opening in the insole is in a heel section of the footwear.

24. The article of footwear of claim 20, further comprising a member extending across the opening and secured to the upper surface of the insole.

25. The article of footwear of claim 24, wherein the member is a barrier.

26. The article of footwear of claim 25, wherein the barrier is a flexible membrane.

27. The article of footwear of claim 20, wherein the sole element extends through the opening in the insole and is secured to the upper surface of the insole in the region of the opening.

28. An article of footwear which comprises:

(a) an insole having an upper surface a lower surface, and an opening;

(b) a sole element comprising an impact energy absorbing material molded to the lower surface of the insole and extending through the opening in the insole and projecting above the upper surface of the insole and forming a dome shaped load transfer region for transferring load between a foot of a wearer of the footwear and the sole element;

(c) a member extending across the opening and secured to the upper surface of the insole; and (d) a reinforcing member embedded in the sole element in the region of the opening in the insole.

29. The article of footwear of claim 28, wherein the opening in the insole is in a heel section of the footwear.

30. The article of footwear of claim 28, wherein the impact energy absorbing material is a resilient material.

31. The article of footwear of claim 30, wherein the impact energy absorbing material comprises polyurethane.

32. The article of footwear of claim 31, wherein the impact energy absorbing material is expanded polyurethane.

33. The article of footwear of claim 30, wherein the impact energy absorbing material comprises natural rubber or synthetic rubber.

34. The article of footwear of claim 30, wherein the impact energy absorbing material comprises PVC.

* * * * *